United States Patent [19]

Fluester

[11] 4,117,710

[45] Oct. 3, 1978

[54] BLIND RIVETING TOOLS

[75] Inventor: James F. Fluester, Thornton Heath, England

[73] Assignee: Spiralux Limited, England

[21] Appl. No.: 791,778

[22] Filed: Apr. 28, 1977

[30] Foreign Application Priority Data

May 5, 1976 [GB] United Kingdom ..... 18398/76

[51] Int. Cl.[2] ..... B21J 15/34

[52] U.S. Cl. ..... 72/391

[58] Field of Search ..... 72/391, 114; 279/123, 279/110

[56] References Cited

U.S. PATENT DOCUMENTS

| | | | |
|---|---|---|---|
| 1,875,737 | 9/1932 | Johnson | 279/123 |
| 3,196,662 | 7/1965 | Simmons | 72/391 |
| 3,324,700 | 6/1967 | Elliott | 72/391 |
| 3,363,445 | 1/1968 | Sanders | 72/391 |
| 3,768,297 | 10/1973 | Martin | 72/391 |

*Primary Examiner*—C.W. Lanham
*Assistant Examiner*—Gene P. Crosby
*Attorney, Agent, or Firm*—Lane, Aitken, Dunner & Ziems

[57] ABSTRACT

A blind riveting tool incorporates a jaw mechanism provided with a multi-part collet. The jaw mechanism includes a generally tubular member whose bore tapers towards that end of the mechanism through which enters the mandrel of a rivet. The internal surface of each part of the collet is provided with a longitudinal groove.

7 Claims, 5 Drawing Figures

BLIND RIVETING TOOLS

BACKGROUND OF THE INVENTION

This invention relates to a multi-part collet for a blind riveting tool and a blind riveting tool incorporating a collet. The invention is also applicable to other tools in which rods or pins are gripped intermittently by means of a collet.

One commercially successful design of a blind riveting tool possesses a jaw mechanism in which the mandrel of the rivet is gripped by a multi-part collet which is spring biased to grip the mandrel. The collet is housed within a tubular member whose bore is tapered and the outer surface of the collet is provided with corresponding tapers so that a different sized mandrel can be accepted by relative adjustment of the position of the collet within the tubular housing. Such collets are normally provided in two parts and the inner surfaces of the collet formed with transverse indentations or ridges in order to provide a better gripping surface. A disadvantage of the existing design of collet is that when a large run of one particular diameter rivet is used, the area of gripping surface becomes clogged with swarf from the rivet mandrels, even after a relatively short time of such use, and the tool begins to slip.

U.S. Pat. No. 3,363,445 goes some way toward solving this problem by providing a multi-part collet whose collet parts have stepped ridged gripping surfaces provided with V-shaped grooves. Although these V-shaped grooves help remove swarf, they do not prevent its formation. Thus, as the serrations at the points of contact with the mandrel of a blind rivet are tangential, the contact area is relatively large and so a relatively low contact pressure is generated. This in turn leads to slippage and generation of swarf which eventually clogs up the gripping surfaces.

SUMMARY OF THE INVENTION

The present invention provides a multi-part collet for a blind riveting tool, wherein the internal surface of each part of the collet is provided with at least one longitudinal groove.

Advantageously, that portion of the internal surface of each collet part which, in use, forms a gripping surface for the mandrel of a rivet, is formed with a plurality of transverse ridges. Preferably, the channel or each groove of each collet part extends over the entire length of said ridged portion.

The grooves in the collet parts reduce the contact area between the collet and the mandrel thereby increasing the effective contact pressure between the mandrel of a blind rivet and the collet so that the collet bites more deeply into the mandrel. Consequently, the chance of slippage between the collet and the mandrel is reduced, which enables far longer runs of use of the tool without the necessity of cleaning or replacing the collets. The problem of slippage between the jaws and the mandrel is most pronounced in the case of small rivets since the amount of force which can be applied to the mandrel is limited to that needed to upset the rivet. As a consequence of reducing the contact area, the same force results in greater penetration of the mandrel by the collet, leading to reduced slippage and less swarf creation.

The invention also provides a blind riveting tool incorporating a jaw mechanism provided with a multi-part collet as defined above.

BRIEF DESCRIPTION OF THE DRAWINGS

The invention will now be described in greater detail, by way of example, with reference to the accompanying drawings, in which.

DESCRIPTION OF PREFERRED EMBODIMENT

Figure 1:
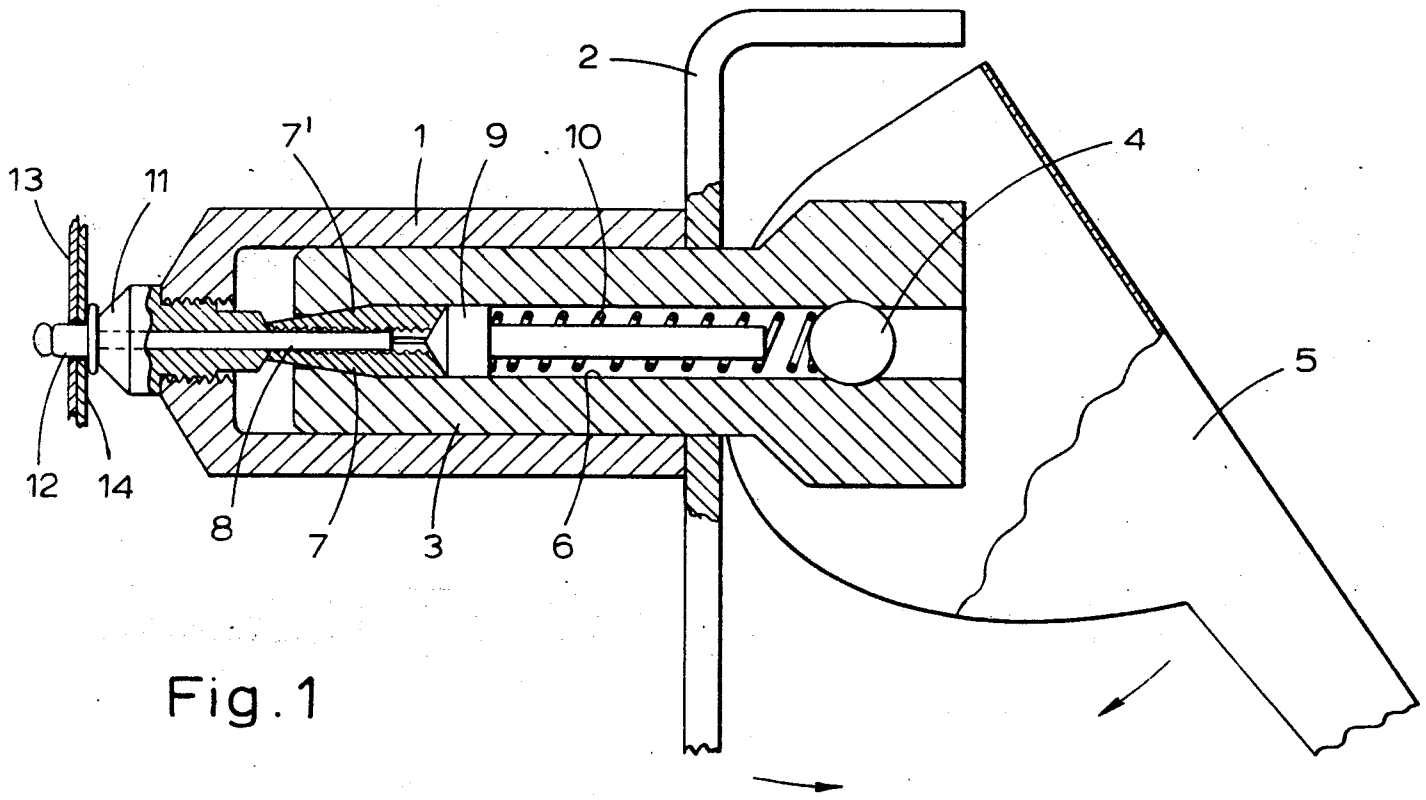
FIG. 1 is a part-sectional elevation of the jaws and associated parts of a blind riveting tool with a rivet in place in the jaws.

Referring to FIG. 1 of the accompanying drawings, the jaws of the riveting tool are contained within a tubular housing 1 which is fixed at one end of one of the handles 2 of the tool. The jaw assembly of the tool is received within the housing 1, the jaw assembly comprising a member 3 which is pivotally mounted by a pivot 4 on the other handle 5 of the tool. The member 3 contains a longitudinal bore 6 housing a two-part collet 7, 7'. The forward end of the bore 6 is formed with a taper as shown and the external surfaces of the collet 7, 7' are formed with corresponding tapers. It will thus be appreciated that the collet 7, 7' is able to receive the mandrels 8 of blind rivets of different diameters according to the extent by which the nose of the collet extends out of the bore 6 in the member 3. The collet 7, 7' is urged outwardly by a plunger 9 and a coil spring 10 acting between the plunger and the pivot 4. A nipple 11 is screwed into the nose of the housing 1 and has a bore therethrough which is appropriate to the size of the mandrel 8 of a blind rivet 12. Usually, the riveting tool is sold with two or more nipples 11 having bores of different diameters for accepting rivets of different sizes. In use, the handles 2 and 5 of the blind riveting tool are pulled together as indicated by the arrows and this action upsets the end of the rivet remote from the tool causing riveting together of plates 13 and 14.

Figure 2:
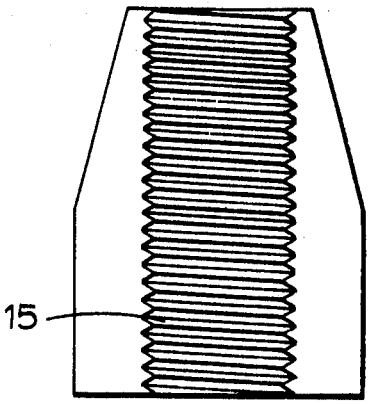
Fig. 2 PRIOR ART
FIG. 2 is an elevation of one part of a two-part conventional collet.
Figure 3:
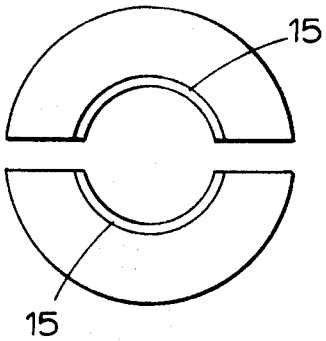
PRIOR ART Fig. 3
FIG. 3 is an end view of the two-part collet in FIG. 2.

One known form of collet is shown in FIGS. 2 and 3 from which it will be seen that the internal surface of the collet parts are formed with a grooved transverse pattern 15 of sharp ridges which enable the parts of the collet to grip a rivet mandrel. It will be appreciated that the gripping action performed by the collet will be concentrated in different parts of the grooved area for different sized rivets and an extended run of riveting work using a particular sized rivet will cause the grooved area of the collet in these parts to be clogged with swarf.

Figure 4:
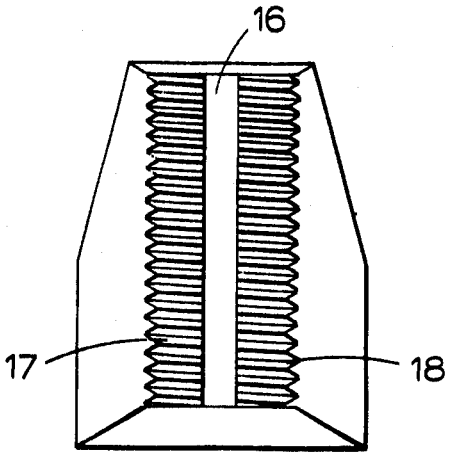
FIG. 4 is an elevation of one part of a two-part collet constructed in accordance with the invention.
Figure 5:
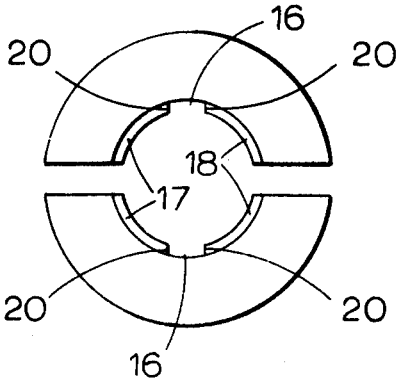
FIG. 5 is an end view of the completer two-part collet shown in FIG. 4.

A collet constructed in accordance with the invention is shown in FIGS. 4 and 5 from which it is apparent that the internal faces of the collet are formed with a channel or groove 16 which divides a similar pattern of ridges into two ridged areas 17 and 18. Each groove 16 is shaped as is shown in FIGS. 4 and 5 and thus has a profile which is substantially like that of a "square wave" form. The formation of the grooved area in this way reduces the area of contact between the collet and the mandrel and provides areas of point contact between the collet and the mandrel in the areas indicated by the reference numerals 20 in the boundary between the channels 16 and the ridged areas 17 and 18. This arrangement has the effect of increasing the effective contact pressure between the collet and the mandrel, thus enabling the collet to penetrate and grip the mandrel more deeply and therefore grip it more securely. As a result there is less tendency for slip to occur between the jaws and the mandrel during upsetting of the rivet and the generation of swarf is consequently greatly reduced, thereby enabling the tool to be used for greater runs without being cleaned or the collets changed.

Moreover, any swarf generated can escape along the grooves 16 which further prevents build up of swarf and further increases the length of runs which the tool can do without changing or cleaning the collets.

The collets may be produced by any suitable method, for example, machining or casting and the ridged areas and channels or grooves may be formed by pressing or machining. Normally the collets are given a final case hardening treatment.

It will be appreciated that the collets may be formed with more than one channel or groove and that the invention is applicable to all power and hand operated tools where a collet is provided for firmly gripping a mandrel or similar pin.

I claim:

1. A multi-part collet for a blind riveting tool, the internal surface of each part of the collet being provided with a shape which further includes a longitudinal groove, that portion of the internal surface of each collet part which forms a gripping surface for the mandrel of a rivet being formed with a plurality of transverse ridges, and the groove of each collet part extending over the entire length of said ridged portion, wherein each longitudinal groove is so shaped that it defines with the adjacent edges of each transverse ridge areas a substantial point contact with the mandrel of a blind rivet.

2. A collet according to claim 1, wherein each groove is of substantially "square-wave" form profile.

3. A collet according to claim 1, wherein the collet has two identical parts.

4. A collet according to claim 1, wherein the outer surface of each collet part tapers towards one end thereof.

5. A blind riveting tool incorporating a jaw mechanism provided with a multi-part collet, the jaw mechanism including a generally tubular member whose bore tapers toward that end of the mechanism through which enters the mandrel of a rivet, wherein the internal surface of each part of the collet is provided with a shape which further includes a longitudinal groove, that portion of the internal surface of each collet part which forms a gripping surface for the mandrel of a rivet being formed with a plurality of transverse ridges, and the groove of each collet part extending over the entire length of said ridged portion, wherein each longitudinal groove is so shaped that it defines with the adjacent edges of each transverse ridge areas a substantial point contact with the mandrel of a blind rivet.

6. A tool according to claim 5, wherein the collet is spring biased towards said end of the mechanism whereby the mandrel of a rivet is, in use, gripped by the collet.

7. A blind riveting tool incorporating a jaw mechanism provided with a multi-part collet, the jaw mechanism including a generally tubular member whose bore tapers towards that end of the mechanism through which enters the mandrel of a rivet, the collet being spring biased towards said end of the mechanism whereby the mandrel of a rivet is gripped by the collet, wherein the collet has two identical parts, the internal surface of each collet part being provided with a shape which further includes a longitudinal groove, and wherein that portion of the internal surface of each collet part which forms a gripping surface for the mandrel of a rivet is formed with a plurality of transverse ridges, the groove of each collet part extending over the entire length of said ridged portion, wherein each longitudinal groove is so shaped that it defines with the adjacent edges of each transverse ridge area a substantial point contact with the mandrel of a blind rivet.

* * * * *